United States Patent [19]

Conlogue et al.

[11] Patent Number: 4,690,115

[45] Date of Patent: Sep. 1, 1987

[54] ENGINE GOVERNOR

[75] Inventors: James H. Conlogue, Westmont; Henry Banker, Villa Park, both of Ill.

[73] Assignee: Hoof Products Co., Chicago, Ill.

[21] Appl. No.: 761,969

[22] Filed: Aug. 2, 1985

[51] Int. Cl.[4] ..... F02D 1/04

[52] U.S. Cl. ..... 123/366; 123/367; 123/373; 123/198 DB

[58] Field of Search ..... 123/373, 367, 366, 365, 123/364, 363, 198 DB

[56] References Cited

U.S. PATENT DOCUMENTS

| | | | |
|---|---|---|---|
| 2,241,096 | 5/1941 | McCullough | 123/364 |
| 2,503,946 | 4/1950 | Hallett | 123/373 |
| 2,645,474 | 7/1953 | Barnes | 123/198 DB |
| 2,646,269 | 7/1953 | Jennings . | |
| 4,355,609 | 10/1982 | Skinner | 123/373 |
| 4,513,715 | 4/1985 | Braun et al. | 123/366 |

*Primary Examiner*—Andrew M. Dolinar

*Attorney, Agent, or Firm*—Willian, Brinks, Olds, Hofer, Gilson & Lione Ltd.

[57] ABSTRACT

A mechanical engine governor includes a gear driven input shaft and an output shaft. A fly-weight assembly is mounted on the input shaft to apply a torque to the output shaft which varies as a function of the rotational speed of the input shaft. An output plate assembly is secured to the output shaft to rotate with the output shaft and is coupled to a fuel metering device such as a fuel injection system for a diesel engine. A stop plate is mounted to rotate about the output shaft, and a spring is mounted between the output plate assembly and the stop plate. At engine speeds below 500 RPM this spring rotates the output plate assembly with respect to the stop plate to provide increased fuel delivery to the engine during engine start up. At speeds greater than 500 RPM the stop plate insures that the governor commands no more than a predetermined maximum continuous fuel flow to the engine.

8 Claims, 10 Drawing Figures

FIG. 9
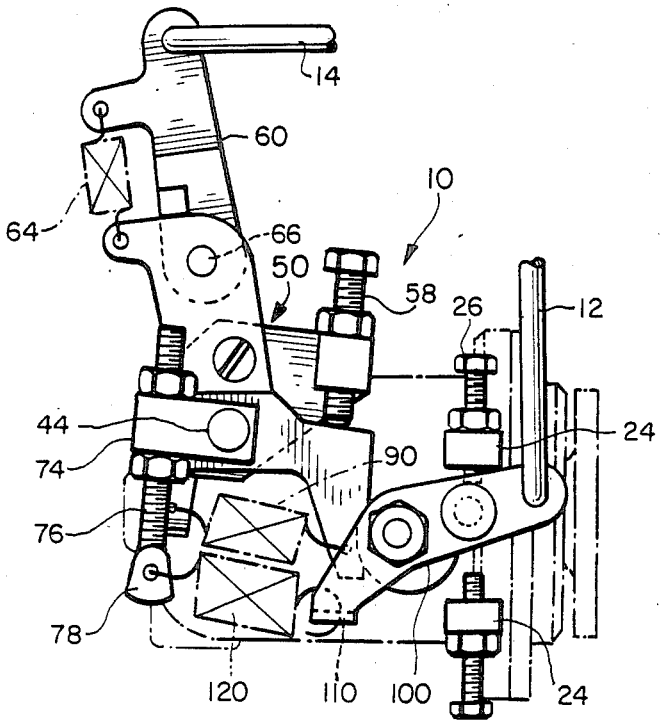
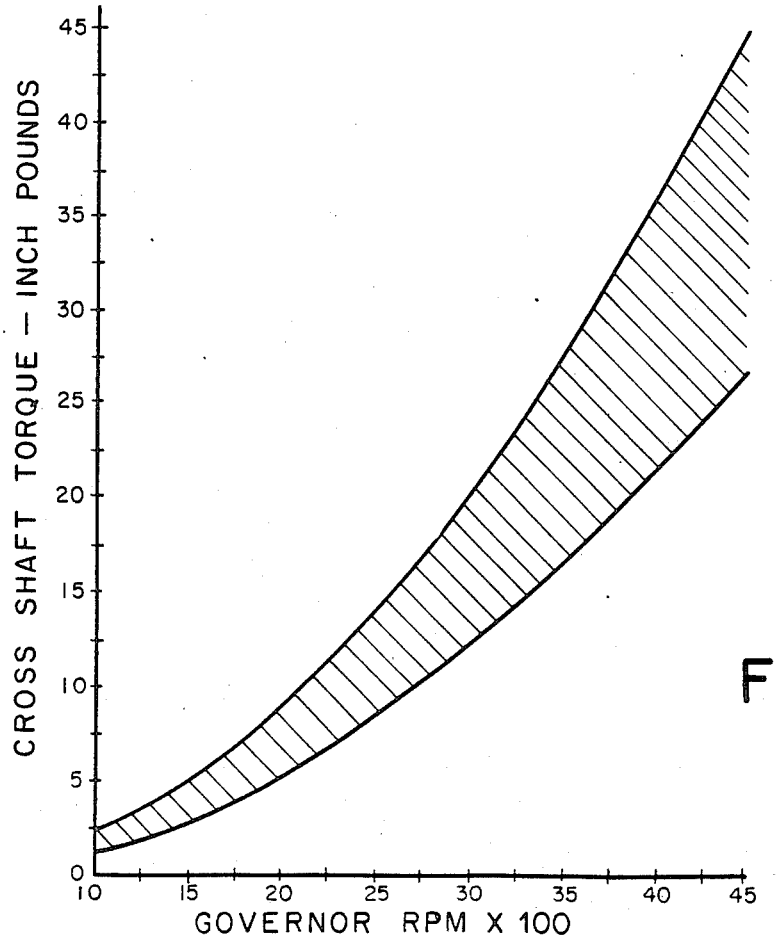
FIG. 10

ENGINE GOVERNOR

BACKGROUND OF THE INVENTION

This invention relates to engine governors used to govern the speed of an engine, such as, for example, an internal combustion engine. More particularly, this invention relates to such an engine governor which automatically increases the fuel flow to the engine during engine start up.

Mechanical engine governors have been used in a wide variety of applications in the past. One example of a prior art mechanical engine governor is shown in U.S. Pat. No. 2,646,269, assigned to the assignee of this invention. Engine governors of this type include fly-weights mounted to a shaft which is rotated at a rate proportional to the speed of the engine being governed. As the fly-weights rotate, they develop a torque on a cross shaft, which torque is an increasing function of governor speed. The torque on the cross shaft is used to control the position of an output member, which is linked to the fuel metering device of the engine. Engine speed above a preset value results in increased torque on the cross shaft and reduced fuel to the engine, and conversely engine speed below the preset value results in reduced torque on the cross shaft and increased fuel to the engine.

When such engine governors are used in automatic engine starting systems, it is often necessary to provide additional features, such as increased fuel flow during engine start up, for example. In the past, one commonly used approach to providing increased fuel during engine start up has been to mount a separate solenoid which is linked to the governor. This solenoid is energized during engine start up, and it operates to increase fuel flow above that commanded by the governor. This approach can be effective if properly implemented. However, it requires the use of an additional component, the solenoid, and it brings with it the expenses associated with the solenoid and the need to mount the solenoid in place.

The present invention is directed to an improved engine governor which automatically provides increased fuel flow to the engine during engine start up.

SUMMARY OF THE INVENTION

This invention is intended for use in an engine governor of the type comprising an input member, an output member, and means for regulating the position of the output member as a function of the rotational speed of the input member such that the position is indicative of the desired rate of fuel flow to an engine. According to this invention, means are included in the governor for limiting the position of the output member to a first selected range when the rotational speed of the input member is greater than a first selected value, and this first selected range is characterized by a maximum continuous fuel flow rate. Means are also included in the governor for biasing the output member to a second selected range, outside the first selected range, when the rotational speed of the input member is less than a second selected value, no greater than the first selected value. This second selected range corresponds to a fuel flow rate greater than the maximum continuous fuel flow rate.

In the preferred embodiment described below, the engine governor also includes a two part output member which allows fuel flow to the engine to be shut off, regardless of the fuel flow commanded by the governor. This embodiment also includes a selection lever which allows either of two engine speeds to be selected.

The preferred embodiment described below provides important advantages. Because the over-fuel system is integrated with the governor, the governor of this invention is compact and low in cost. It is well-suited for a variety of engines, and is particularly well adapted for use with small diesel engines.

The invention itself, together with further objects and attendant advantages, will best be understood by reference to the following detailed description, taken up in conjunction with the accompanying drawings.

BRIEF DESCRIPTION OF THE DRAWINGS

FIG. 9 is a side view corresponding to FIG. 1 showing the governor at the full fuel position with the governor adjusted to govern at a higher engine speed.

FIG. 10 is a graph showing the relationship between governor RPM and cross shaft torque in the embodiment of FIG. 1.

DETAILED DESCRIPTION OF THE PRESENTLY PREFERRED EMBODIMENTS

Figure 1:
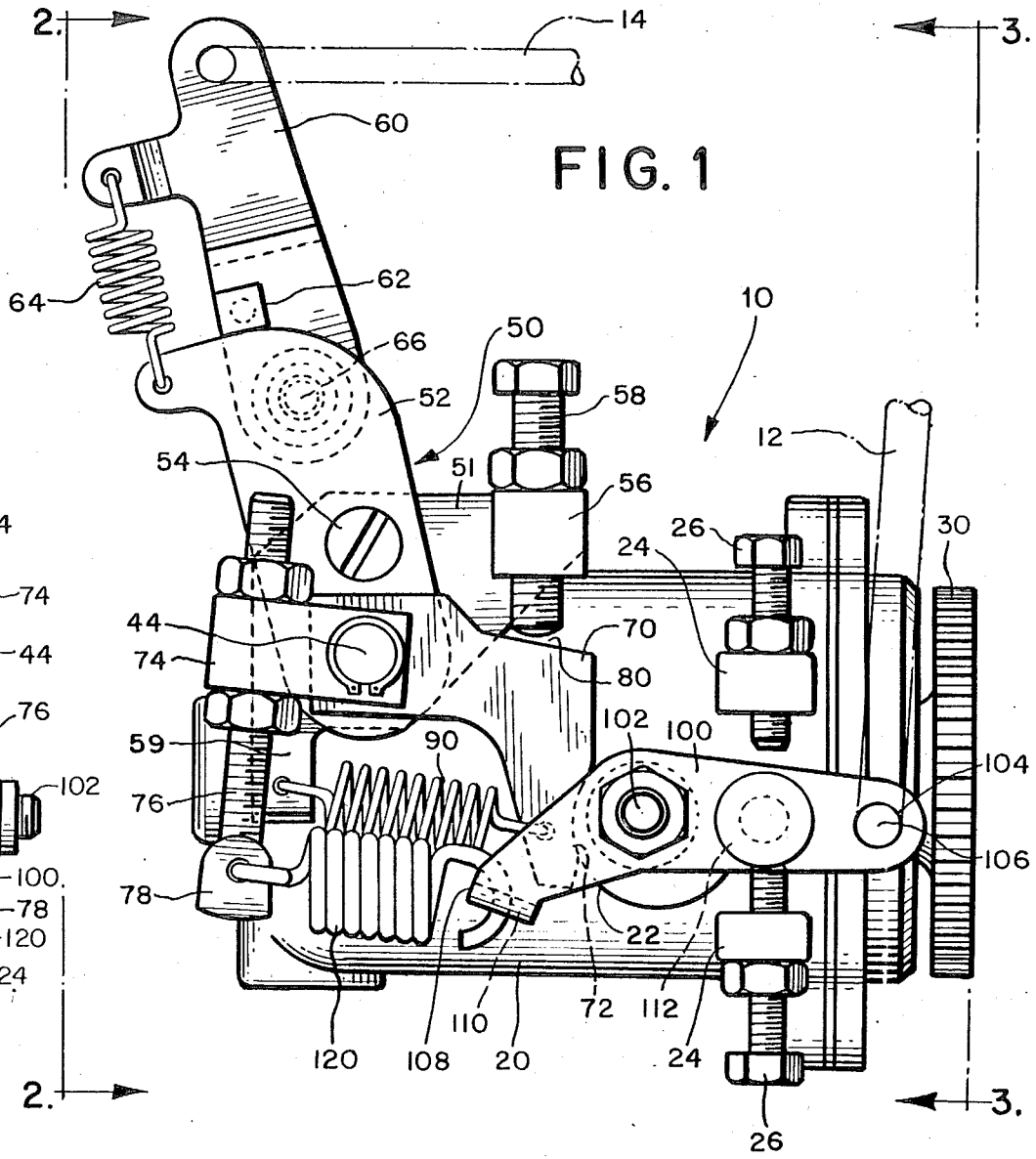
FIG. 1 is a side view of an engine governor which incorporates the presently preferred embodiment of this invention.
Figure 2:
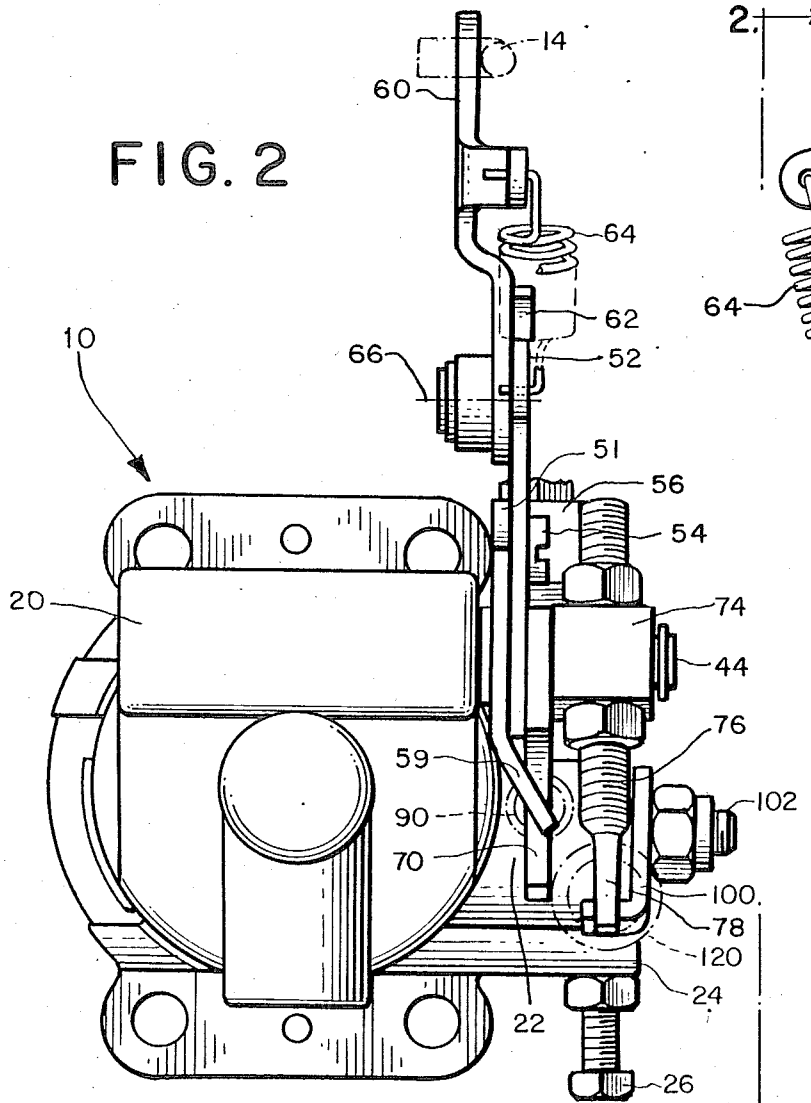
FIG. 2 is an end view taken along line 2—2 of FIG. 1.

Turning now to the drawings, FIGS. 1 through 4 show various views of the presently preferred embodiment of the governor 10 of this invention. This governor 10 includes a rigid housing 20. The housing 20 defines a raised boss 22 which acts as a stop as explained below, as well as a pair of spaced parallel lugs 24. Each of the lugs 24 mounts an adjusting screw 26 adjustably in position with respect to the housing 20.

Figure 4:
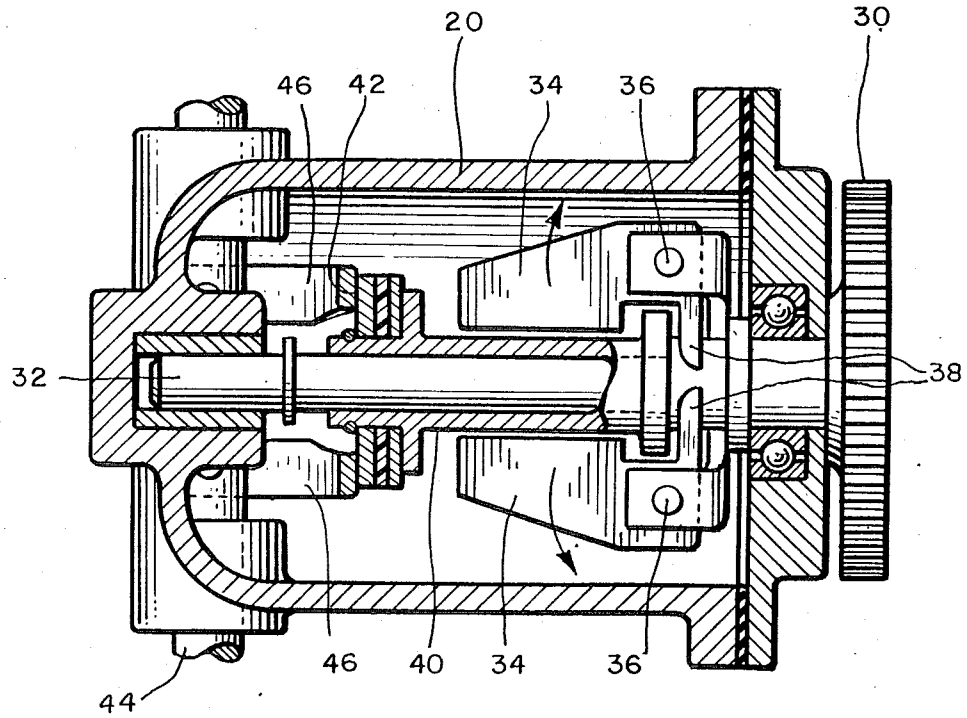
FIG. 4 is a sectional view taken along line 4—4 of FIG. 3.
Figure 3:
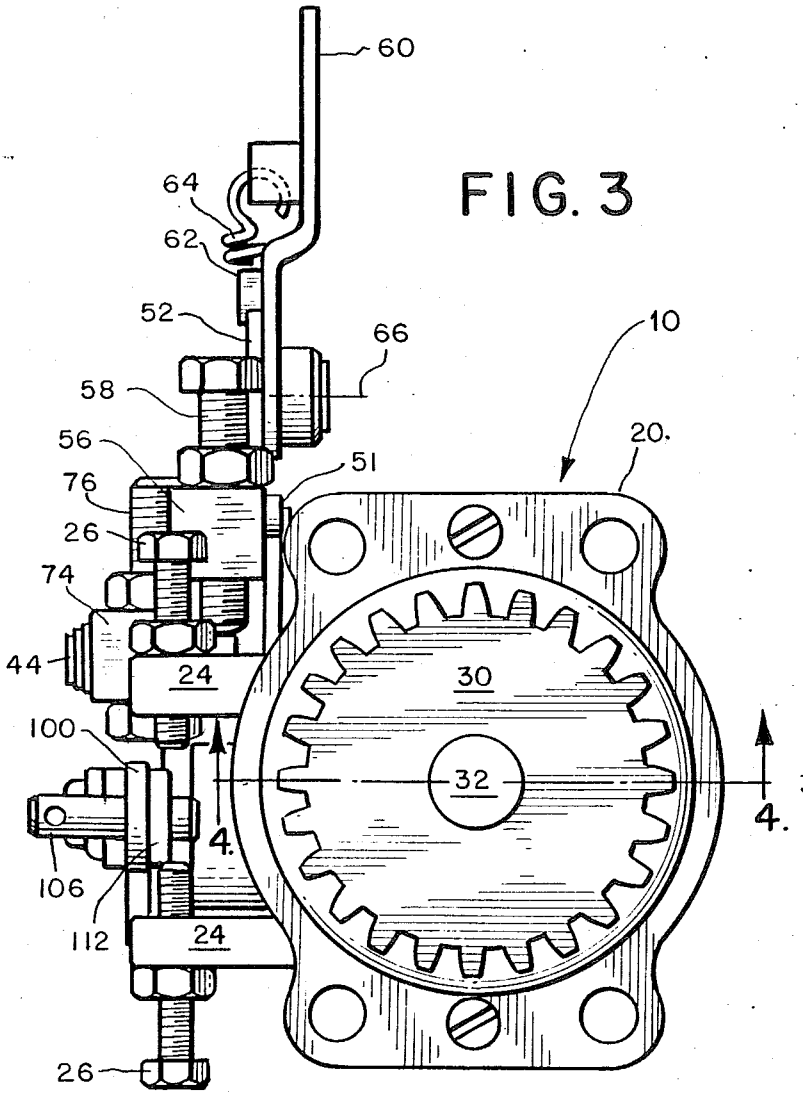
FIG. 3 is an end view taken along line 3—3 of FIG. 1.

As best shown in FIG. 4, an input gear 30 is mounted to an input shaft 32 which is rotatably mounted within the housing 20. A number of fly-weights 34 are mounted to rotate with the input shaft 32, and each of the fly-weights 34 is free to pivot about a respective pivot axis 36. Each of the fly-weights 34 defines a lever arm 38 which extends transverse to the input shaft 32 when the fly-weights 34 are in the position shown in FIG. 4. The lever arms 38 bear on a tube 40 which surrounds the input shaft 32 and is mounted for axial movement along the length of the input shaft 32. This tube 40 defines an annular bearing surface 42 at one end thereof.

An output shaft or cross shaft 44 is mounted for rotation in the housing 20 and extends generally transverse to the input shaft 32. A fork 46 is rigidly mounted to the output shaft 44 to bear on the bearing surface 42. Rotation of the input gear 30 causes the fly-weights 34 to rotate, which tend to pivot outwardly, thereby applying an axial force to the tube 40. This axial force on the tube 40 acts through the fork 46 to apply a torque to the output shaft 44. This torque varies as a function of the rotational speed of the input gear 30.

FIG. 10 provides a graph which defines the torque applied to the output shaft 44 as a function of governor speed in this embodiment. As is apparent from FIG. 10, this torque is an increasing function of governor speed. This torque is applied so as to rotate the outward shaft 44 in a clockwise direction as shown in FIGS. 1 and 5–9. In general, such fly-weight engine governors are well known to those skilled in the art and the detailed construction of the fly-weight assembly does not form part of this invention. A suitable assembly can be formed as described in U.S. Pat. No. 2,646,269, assigned to the assignee of the present invention.

Returning now to FIGS. 1–3, an output plate assembly 50 is pinned to the output shaft 44 to rotate with the output shaft 44. This output plate assembly 50 is made up of first and second output plates 51, 52, which are rigidly secured together by a fastener 54. The first outplate 51 defines a raised lug 56 which serves to mount an adjusting screw 58. This adjusting screw 58 defines a stop surface at its free end. The first output plate 51 also defines a tab 59 on the side of the output shaft 44 opposite the lug 56.

An output plate extension 60 is pivotably mounted to the second output plate 52 to pivot about an axis 66. This output plate extension 60 defines a raised stop 62 positioned to bear against the second output plate 52. A coil spring 64 is mounted between the output plate extension 60 and the second output plate 52 to bias the output plate extension 60 to the position shown in FIG. 1, in which the stop 62 contacts the second output plate 52.

The governor 10 also includes a stop plate 70 which is mounted to rotate freely about the output shaft 44. If desired, a bushing can be provided to facilitate this rotation. The stop plate 70 defines an arcuate stop surface 72 which is shaped and positioned to bear against the stop 22 of the housing 20. Thus, the stop 22 of the housing 20 limits the rotation of the stop plate 70 in a counter-clockwise direction. The stop plate 70 defines a raised lug 74 which is threaded to receive a screw 76 which is flattened at one end. The stop plate 70 also defines an abutting surface 80 positioned to abut the free end of the adjusting screw 58.

A coil spring 90 is mounted between the tab 59 of the first output plate 51 and the stop plate 70. This spring 90 biases the output plate assembly 50 in a counter-clockwise direction.

A selection lever 100 is pivotably mounted to the housing 20 by a fastener 102. This selection lever 100 defines a first end 104 on which is mounted a raised pin 106. The selection lever 100 also defines a second end 108 which defines a downwardly projecting tab 110. A raised boss 112 is mounted to the selection lever 100 between the first end 104 and the fastener 102. This boss 112 is positioned to contact either of the adjusting screws 26 to limit the pivoting motion of the selection lever 100.

A coil spring 120 is mounted between the flattened end 78 of the screw 76 and the tab 110 of the selection lever 100. The spring 120 biases the stop plate 70 in a counter-clockwise direction. When the abutting surface 80 of the stop plate 70 is in contact with the adjusting screw 58, the spring 120 also biases the output plate assembly 50 in the counter-clockwise direction.

When the governor 10 is installed on an engine such as a small diesel engine, for example, a speed selection link 12 is connected to the pin 106. As explained below, this speed selection link 12 can be used by an operator to select one of two speeds at which the engine is to be governed. In addition, a fuel control link 14 is pivotably mounted to the output plate extension 60. This fuel control link 14 may, for example, be connected to the rack of a fuel injection system. This rack when moved in the direction of the arrow 130 reduces the fuel supplied to the engine. Conversely, when the rack is moved in the direction of the arrow 140 the fuel supplied to the engine is increased.

In order better to define the preferred embodiment of this invention, the following details of construction are provided. It should be clearly understood that these details are merely illustrative, and are in no way intended to limit the scope of this invention. The output plate assembly 50 and the stop plate 70 can be formed of conventional materials such as 1010–1020 cold rolled steel. In this embodiment, the first and second output plates 51, 52 are preferably formed of thirteen gauge cold rolled steel, and the stop plate 70 is preferably 5/32 inch in thickness. The spring 120 in this embodiment has a spring constant of 82 pounds per inch, and the adjusting screws 26 are adjusted as appropriate to provide the desired high and low governing speeds. In general, the adjusting screws 26 are adjusted until the spring 120 provides a torque which balances the torque applied to the output shaft 44 by the fly-weights 34 at the desired governing speed. In this embodiment, the gear 30 is sized such that the fly-weights 34 rotate at the same rate as the engine being governed.

In this embodiment, the spring 90 is selected to generate a torque on the output plate assembly 50 of about one inch-pound when the adjusting screw 58 is in contact with the abutting surface 80. The fly-weight assembly provides a torque on the output shaft 44 of about one inch-pound at a governor speed of about 500 RPM At about 500 RPM, the torque applied to the output shaft 44 by the fly-weights 34 exceeds the torque applied on the output shaft 44 by the spring 90. This causes the governor 10 to make a transition from an overfuel configuration at governor speeds below 500 RPM to a standard governing configuration at governor speeds above 500 RPM in which the maximum fuel flow is as determined by the stop 22.

Figure 5:
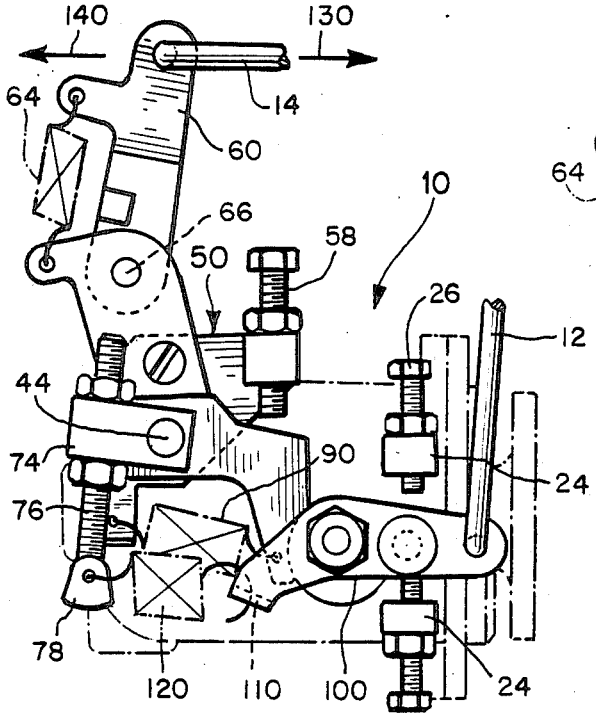
FIG. 5 is a side view corresponding to FIG. 1 showing the governor in a fuel shutoff position.

Turning now to FIGS. 5 through 9, the operation of the governor 10 can now be explained. FIG. 5 shows the governor in the zero fuel position used during engine shutdown. An external solenoid (not shown) is used to pull the fuel control link 14 in the fuel decreasing direction 130, thereby positioning the injection rack so as to stop the delivery of fuel to the engine. In the zero fuel position of FIG. 5, the output plate extension 60 is pivoted with respect to the output plate assembly 50 and the spring 64 is extended by the solenoid (not shown).

Figure 6:
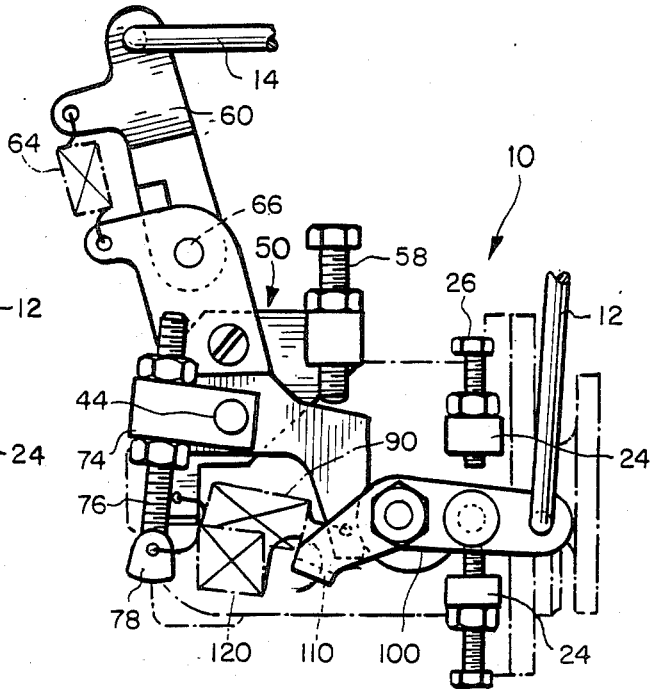
FIG. 6 is a side view corresponding to FIG. 1 showing the governor in an over-fuel position.

FIG. 6 shows the configuration of the governor 10 after the shutdown solenoid is released. When this happens, the spring 64 returns the output plate extension 60 to its normal position. When engine speed is low and the torque applied to the output shaft 44 by the fly-weights 34 is less than the torque applied by the spring 90, the output plate assembly 50 pivots in the fuel increasing direction 140, and a gap is created between the adjusting screw 58 and the abutting surface 80. This causes the fuel control link 14 to be shifted in the fuel increasing direction 140 to an overfuel position. In this way, additional fuel is supplied at low engine speeds during engine start up.

Figure 7:
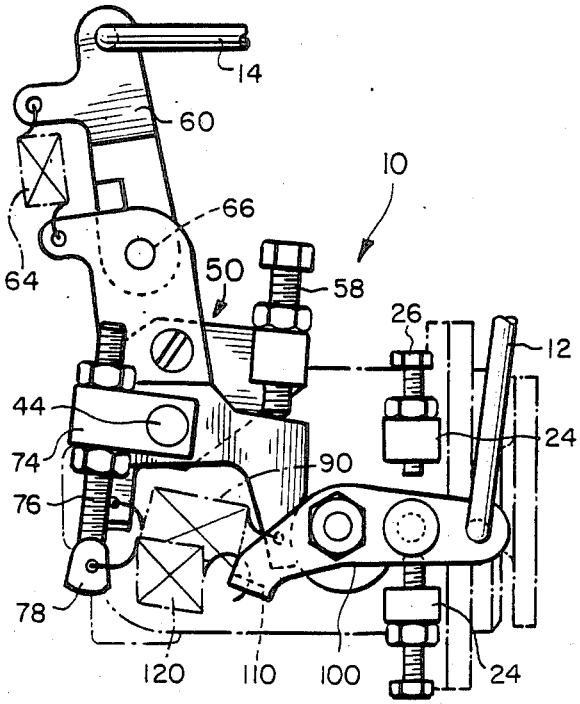
FIG. 7 is a side view corresponding to FIG. 1 showing the governor in a full-fuel position as the engine is coming up to speed.

FIG. 7 shows a configuration of the governor at 10 as the engine speed increases. As shown in the graph of FIG. 10, increasing engine speed results in increasing torque on the output shaft 44. This increasing torque stretches the spring 90 and reduces the gap between the adjusting screw 58 and the abutting surface 80. In FIG. 7, the governor is shown just as the engine speed rises to the point where the adjusting screw 58 is brought into contact with the abutting surface 80.

Figure 8:
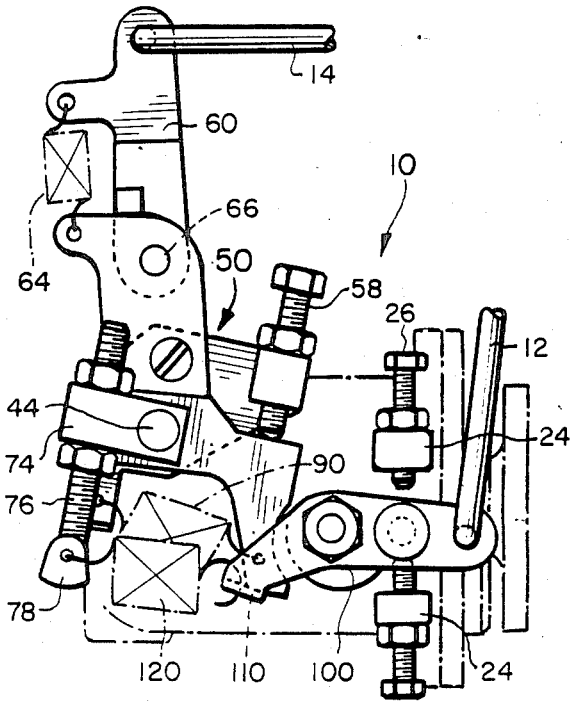
FIG. 8 is a side view corresponding to FIG. 1 showing the governor in a minimum fuel position with the governor adjusted to govern at a low engine speed.

As shown in FIG. 8, as engine speed continues to increase, the increasing torque applied to the output shaft 44 by the fly-weights 34 causes the stop plate 70 to lift off of the stop 22, thereby moving the output plate extension 60 in the fuel decreasing direction 130. This causes the rate of fuel delivery to the engine to be reduced, thereby causing a reduction of the engine speed. In FIG. 8, the selection lever 100 is shown in the low speed position, with the boss 112 in contact with the lower one of the two adjusting screws 26. In this position, the governor will cause the output shaft 44 to rotate between the extreme positions shown in FIGS. 7 and 8 to modulate the fuel flow to the engine in order to control engine speed at the selected low speed position.

FIG. 9 shows the configuration of the governor 10 after the speed selection link 12 has been used to shift the selection lever 100 to the high speed position. In the high speed position, the boss 112 contacts the upper one of the two adjusting screws 26. When the selection lever 100 is in the high speed position shown in FIG. 9, the spring 120 is extended to a greater extent, and the governor 10 controls engine speed at a second, higher value. When the engine speed exceeds this higher value, the governor 10 will rotate the output plate assembly 50 and the stop plate 70 as a unit in the clockwise direction so as to move the fuel control link 14 in the fuel decreasing direction 130.

In the governor 10, the stop 22 defines the maximum fuel flow permitted on a continuous basis. However, when the engine speed drops below a selected value, (500 RPM in this embodiment) the counter-clockwise torque applied to the output shaft 44 by the spring 90 exceeds the clockwise torque applied to the output shaft 44 by the fly-weights 34. This causes the output plate assembly 50 to rotate in a counter-clockwise direction with respect to stop plate 70, thereby increasing the fuel flow to a rate above the maximum continuous fuel flow rate defined by the stop 22. Thus, the governor 10 automatically increases fuel flow during a start up condition when engine speed is low. As engine speed increases, the output plate assembly 50 rotates into contact with the stop plate 70. For engine speeds above the speed at which the output assembly 50 contacts the stop plate 70, the governor 10 operates as a conventional governor to control engine speed.

The pivoting output plate extension 60 allows the governor 10 to be used with an external solenoid for engine shutdown. The solenoid can pivot the output plate extension 60 with respect to the output plate assembly 50 in order to cut off fuel flow to the engine, regardless of the position of the output plate assembly 50.

The selection lever 100 allows an operator to select one of two engine speeds simply by positioning the speed selection link 12 as appropriate.

From the foregoing, it should be apparent that an improved mechanical engine governor has been described which automatically provides increased fuel to the engine during engine start up by means of a linkage which is fully integrated with the governor linkage and which does not represent a substantial increase in the size, complexity, or cost of the governor itself.

Of course, it should be understood that a wide range of changes and modifications can be made to the preferred embodiment described above. For example, the details of construction of the fly-weight assembly can be modified as needed. Furthermore, spring constants, dimensions and proportions can be modified as appropriate for individual applications. It is of course not necessary that all embodiments of this invention include the selection lever 100 or the output plate extension 60. It is therefore intended that the foregoing detailed description be regarded as illustrative rather than limiting, and that it be understood that it is the following claims, including all equivalents, which are intended to define the scope of this invention.

We claim:

1. In an engine governor of the type comprising a housing; an input shaft, rotatably mounted to the housing; an output shaft, rotatably mounted to and extending into the housing; and means, included within the housing, for applying a torque to the output shaft in a fuel decreasing direction as a selected function of the rotational speed of the input shaft, the improvement comprising:

an output plate mounted to the output shaft outside of the housing to rotate with the output shaft;

a stop plate mounted to rotate freely about the output shaft;

a stop secured to the housing and positioned to abut the stop plate to limit movement of the stop plate in a fuel increasing direction, opposed to the fuel decreasing direction;

an additional stop secured to the output plate to cause the stop plate to rotate with the output plate in the fuel decreasing position and to allow the output plate to rotate independently of the stop plate in the fuel increasing direction;

a first spring coupled to the stop plate;

means for securing the first spring to the housing such that the first spring biases the stop plate against the stop in the fuel increasing direction;

a second spring coupled between the stop plate and the output plate to bias the output plate in the fuel increasing direction with respect to the stop plate;

said second spring operative to move the output plate into an over fuel range of positions when the rotational speed of the input shaft is less than a selected value and the torque applying means applies a lesser torque to the shaft than that applied by the second spring; and said stop operative to limit movement of the output plate to a range of positions characterized by a maximum continuous fuel position when the rotational speed of the input shaft is greater than the selected value and the torque applying means applies a greater torque to the shaft than that applied by the second spring.

2. The invention of claim 1 wherein the first spring securing means comprises:

a selection lever pivotably mounted to the housing and connected to the first spring; and means, mounted to the housing, for defining first and second extreme positions for the selection lever.

3. The invention of claim 1 further comprising:

an additional plate pivotably mounted to the output plate;

a third spring mounted between the output plate and the additional plate to the bias the additional plate in the fuel increasing direction; and means for limiting movement of the additional plate with respect to the output plate in the fuel increasing direction.

4. The invention of claim 1 wherein the stop secured to the housing comprises a raised arcuate boss on the housing, and wherein the stop plate defines a correspondingly shaped arcuate surface positioned to contact the arcuate boss.

5. The invention of claim 4 further comprising:

a selection lever pivotably mounted to the raised arcuate boss and connected to the first spring; and means, mounted to the housing, for defining first and second extreme positions for the selection lever.

6. The invention of claim 1 wherein the stop plate is generally L-shaped and comprises first and second legs which meet at a corner;

wherein an edge of the first leg is shaped to abut the stop;

wherein the additional stop contacts the stop plate adjacent to the corner; and wherein the first spring is coupled to the stop plate via mounting means secured to the second leg.

7. The invention of claim 6 wherein the output shaft passes through the second leg of the stop plate between the mounting means and the corner.

8. The invention of claim 6 wherein the stop abuts an outside edge of the first leg, and wherein the additional stop contacts the stop plate at an outside edge of the corner.

* * * * *

UNITED STATES PATENT AND TRADEMARK OFFICE

CERTIFICATE OF CORRECTION

PATENT NO. : 4,690,115

DATED : Sept. 1, 1987

INVENTOR(S) : James H. Conlogue et al.

It is certified that error appears in the above-identified patent and that said Letters Patent is hereby corrected as shown below:

In column 2, line 12, please delete "taken up" and substitute therefor --taken--.

IN THE CLAIMS

In Claim 3 (column 7, line 10), please delete "to the bias" and substitute therefor --to bias--.

Signed and Sealed this

Sixteenth Day of August, 1988

*Attest:*

*Attesting Officer*

DONALD J. QUIGG

*Commissioner of Patents and Trademarks*